US011503891B1

(12) United States Patent
Kalendar et al.

(10) Patent No.: US 11,503,891 B1
(45) Date of Patent: Nov. 22, 2022

(54) HAIR DRYER WITH SCENT DISPENSER

(71) Applicant: GIFTEDNESS AND CREATIVITY COMPANY, Safat (KW)

(72) Inventors: Abdulrahim Y. Kalendar, Safat (KW); Gadir E. Alkandari, Safat (KW)

(73) Assignee: GIFTEDNESS AND CREATIVITY COMPANY, Safat (KW)

( * ) Notice: Subject to any disclaimer, the term of this patent is extended or adjusted under 35 U.S.C. 154(b) by 0 days.

(21) Appl. No.: 17/688,839

(22) Filed: Mar. 7, 2022

(51) Int. Cl.

| | |
|---|---|
| ***A45D 20/44*** | (2006.01) |
| ***A45D 34/02*** | (2006.01) |
| ***A46B 9/02*** | (2006.01) |
| ***A46B 15/00*** | (2006.01) |
| ***A45D 20/52*** | (2006.01) |

(52) U.S. Cl.
CPC ..... *A45D 20/44* (2013.01); *A45D 20/525* (2013.01); *A45D 34/02* (2013.01); *A46B 9/023* (2013.01); *A46B 15/003* (2013.01); *A46B 15/0051* (2013.01)

(58) Field of Classification Search
CPC ..... A45D 20/44; A45D 20/525; A46B 9/023; A46B 15/003; A46B 15/0051
USPC ..... 34/95–100; 132/112
See application file for complete search history.

(56) References Cited

U.S. PATENT DOCUMENTS 3,449,838 A * 6/1969 Chancellor, Jr. ..... A45D 20/16 34/233
5,311,616 A * 5/1994 Pratt ..... A47K 10/48 392/394
5,987,771 A 11/1999 Curtin
6,584,985 B2 * 7/2003 Omura ..... B05B 7/2435 132/270
6,751,886 B2 * 6/2004 Chang ..... A45D 20/50 34/96

(Continued)

FOREIGN PATENT DOCUMENTS

EP 1518475 A1 3/2005
GB 981847 A * 1/1965

OTHER PUBLICATIONS

Detwiler, Susan P., et al. "Bubble hair: case caused by an overheating hair dryer and reproducibility in normal hair with heat." Journal of the American Academy of Dermatology 30.1 (1994): 54-60.

(Continued)

*Primary Examiner* — Stephen M Gravini
(74) *Attorney, Agent, or Firm* — Nath, Goldberg & Meyer; Richard C. Litman

(57) ABSTRACT

The hair dryer with a scent dispenser includes a housing with an air outlet at a first end thereof, and an air inlet at a second end thereof. An airflow conduit is disposed within the housing. A fan is mounted within the airflow conduit for drawing air into the airflow conduit, and a heating element is mounted within the airflow conduit for heating the air. The heated air is blown by the fan through the airflow conduit and out the air outlet. A scent container is received within the housing for storing a scented liquid. An air pump is in fluid communication with the scent container for delivering pressurized air into the scented liquid to produce scented air. The scent container is in fluid communication with the airflow conduit such that the scented air mixes with the heated air within the airflow conduit.

19 Claims, 8 Drawing Sheets

(56) References Cited

U.S. PATENT DOCUMENTS

| | | | | |
|---|---|---|---|---|
| 7,093,376 | B2 * | 8/2006 | Regen | A45D 20/12 132/200 |
| 10,849,400 | B2 * | 12/2020 | Weatherly | A45D 20/12 |
| 10,873,191 | B2 * | 12/2020 | Chien | H02J 7/0047 |
| 2005/0198854 | A1 * | 9/2005 | Hobe | A45D 20/12 34/96 |
| 2008/0235980 | A1 | 10/2008 | Chasen et al. | |
| 2017/0027301 | A1 * | 2/2017 | Mazed | A45D 19/16 |
| 2018/0028709 | A1 | 2/2018 | Fujita et al. | |
| 2018/0042356 | A1 | 2/2018 | Pavis et al. | |
| 2018/0064227 | A1 * | 3/2018 | Matheny | A45D 20/122 |
| 2018/0084227 | A1 | 3/2018 | Matheny | |
| 2019/0231918 | A1 * | 8/2019 | Rubin | B01D 46/2411 |
| 2020/0305587 | A1 * | 10/2020 | Mazed | A61K 8/735 |
| 2020/0390217 | A1 * | 12/2020 | Chiastra | A45D 20/122 |
| 2021/0388989 | A1 * | 12/2021 | Thom | F24B 1/19 |

OTHER PUBLICATIONS

Petrovicova, E., et al. "Heat transfer in human hair." International journal of cosmetic science 41.4 (2019): 387-390.

* cited by examiner

HAIR DRYER WITH SCENT DISPENSER

BACKGROUND

1. Field

The disclosure of the present patent application relates to hair dryers, and particularly to a hair dryer with scent dispenser that selectively mixes a scent into the heated air stream.

2. Description of the Related Art

In order to provide even and controlled drying, particularly when a user is wearing hair curlers or the like, hair salons use hooded hair dryers, which make use of an air-dispensing hood worn over the user's head. Smaller versions of such hooded hair dryers are popular for home or portable use, such as the conventional hair dryer 100 shown in FIG. 2, which makes use of a soft bonnet 102 instead of the hard hood commonly found in salons. Environmental air A is drawn inside housing 106, through an inlet 104, by a conventional fan. The environmental air A is heated by a conventional heating element. Both the fan and the heating element are mounted within the housing 106. The heated air is delivered, under power of the fan, through an internal airflow tube 110, where it exits housing 106 through an outlet 108. Hose 112 is connected to outlet 108 to deliver the heated air to the interior of soft bonnet 102, which is worn on the user's head, covering the hair. An example of such a conventional hair dryer is the Model SB1RN Soft Bonnet Hair Dryer, manufactured by Conair®.

Unlike a handheld hair dryer, which users wave over their hair, constantly moving the stream of heated air from one place to the other, hooded or bonneted hair dryers, such as hair dryer 100 of FIG. 2, provide a continuous stream of hot air to the user's hair and scalp, thus increasing the risk of damage to the hair. The overheating of hair is known to cause a condition referred to as "bubble hair", which includes structural damage to the individual hair fibers. Additionally, human hair has been shown to have relatively good heat conduction properties, but relatively poor heat transfer properties from convection. The difference in heat transfer rates during blow drying, which makes use of both conduction and convection at the same time, results in noticeable heat gradients along the length of the hair shaft, resulting in the aforementioned bubble hair, as well as other undesirable damage to the hair. A result of this heat damage is a distinctive odor, often referred to as that of burning hair.

The odor of burning hair may be masked through the use of perfumes or incense. However, the direct spraying of perfume into hair can cause further damage to the hair, as well as putting the user at risk from accidental spraying of the perfume into his or her eyes. Similarly, attempting to apply incense smoke to the hair can also put the user at risk of accidental burns and smoke exposure to the user's eyes, nose and mouth. Thus, a hair dryer with a scent dispenser solving the aforementioned problems is desired.

SUMMARY

The hair dryer with scent dispenser is a hair dryer that mixes a selected scent and/or incense smoke into the output heated air. The hair dryer includes a housing having opposed first and second ends, an air outlet formed at the first end, and an air inlet at the second end. A hood, flexible bonnet or the like may be provided for wearing over the hair of the user. The hood, flexible bonnet or the like has a heated air inlet for releasable connection to a hose. A first end of the hose is releasably attached to the air outlet of the housing, and an opposed second end of the hose is connected to the heated air inlet of the hood. A portion of the housing may also define a storage compartment adjacent the second end of the housing, providing storage for the hose and hood, combs, brushes and the like. The storage compartment may be releasably covered by a door for securing the items within during transport and storage of the hair dryer.

Alternatively, the hood may be included as one of a group of interchangeable accessories. A scent dispensing hair dryer kit may be provided, including the hair dryer with the scent dispenser, the hood, as described above, along with a heated air dispensing comb adapted for combing the hair of the user while simultaneously blowing the heated and scented air, and a heated air dispensing brush adapted for brushing the hair of the user while simultaneously blowing the heated and scented air. Similar to the hood described above, each of the heated air dispensing comb and the heated air dispensing brush has a heated air inlet for releasable connection to the second end of the hose. The hood, the heated air dispensing comb, and the heated air dispensing brush are interchangeable, depending upon the needs of the user. It should be understood that any suitable heated air accessories may be provided as part of the kit, and that the kit is not limited to, or limited to requiring, the hood, heated air dispensing comb, and heated air dispensing brush.

An airflow conduit is received within the housing. The airflow conduit has opposed first and second ends, the first end of the airflow conduit being positioned adjacent to the housing's air outlet, and the second end of the airflow conduit being positioned adjacent to the housing's air inlet. A fan is mounted within the airflow conduit for drawing air into the airflow conduit, and a heating element is also mounted within the airflow conduit for heating the air. The heated air is blown by the fan through the airflow conduit and out through the housing's air outlet. A scent container is disposed within the housing for storing a scented liquid, such as perfume, cologne, scented oil, hair treatment ampoules or the like. An air pump is in fluid communication with the scent container for delivering pressurized air into the scented liquid to produce scented air. The scent container is in fluid communication with the airflow conduit such that the scented air mixes with the heated air within the airflow conduit. The air pump may be a variable speed air pump, providing variable control over the concentration of the scent within the heated air.

A removable cap may be provided for releasably covering and sealing the scent container. The removable cap has an inlet port and an outlet port. The inlet port is in fluid communication with the air pump for receiving the pressurized air, and the outlet port is in fluid communication with a scent port of the airflow conduit for delivering the scented air to the airflow conduit. A diffuser may be received within the scent container for diffusing the pressurized air within the scented liquid in the scent container. A delivery tube is in fluid communication with the inlet port of the removable cap and the diffuser for delivering the pressurized air to the diffuser.

Additionally, the housing may also include an incense burning compartment adjacent to the air inlet for producing incense smoke to be mixed with the air drawn into the airflow conduit. The incense burning compartment includes a removable smoke conduit having a smoke vent formed therein, a heater, and a screen mounted over the heater. The screen may be supported by at least one spring. The screen is adapted for supporting incense to be burned by the heater. The removable smoke conduit is positioned over the heater and the screen such that the incense smoke flows through the smoke vent and into the removable smoke conduit.

These and other features of the present subject matter will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
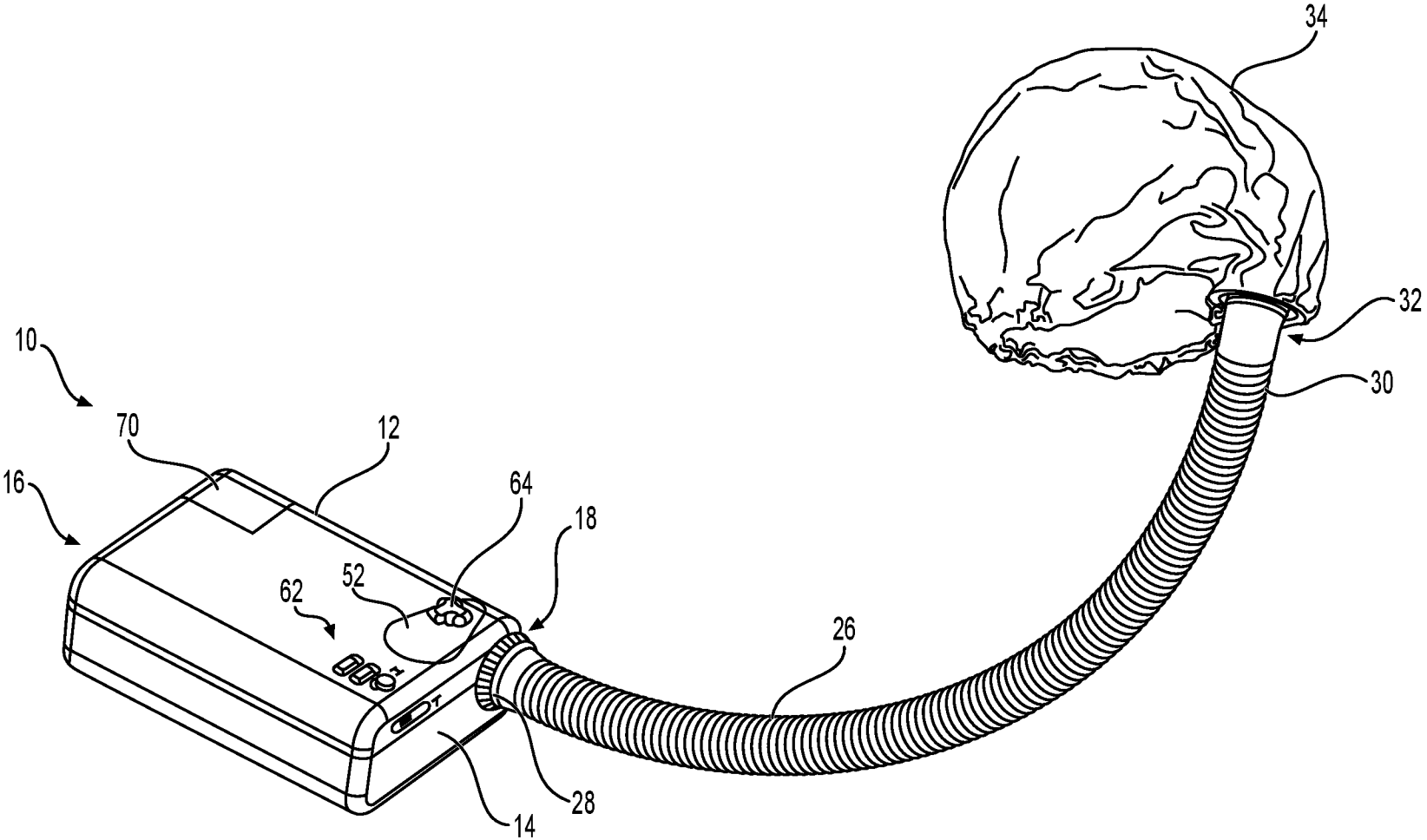
FIG. 1 is a perspective view of a hair dryer with a scent dispenser.
Figure 2:
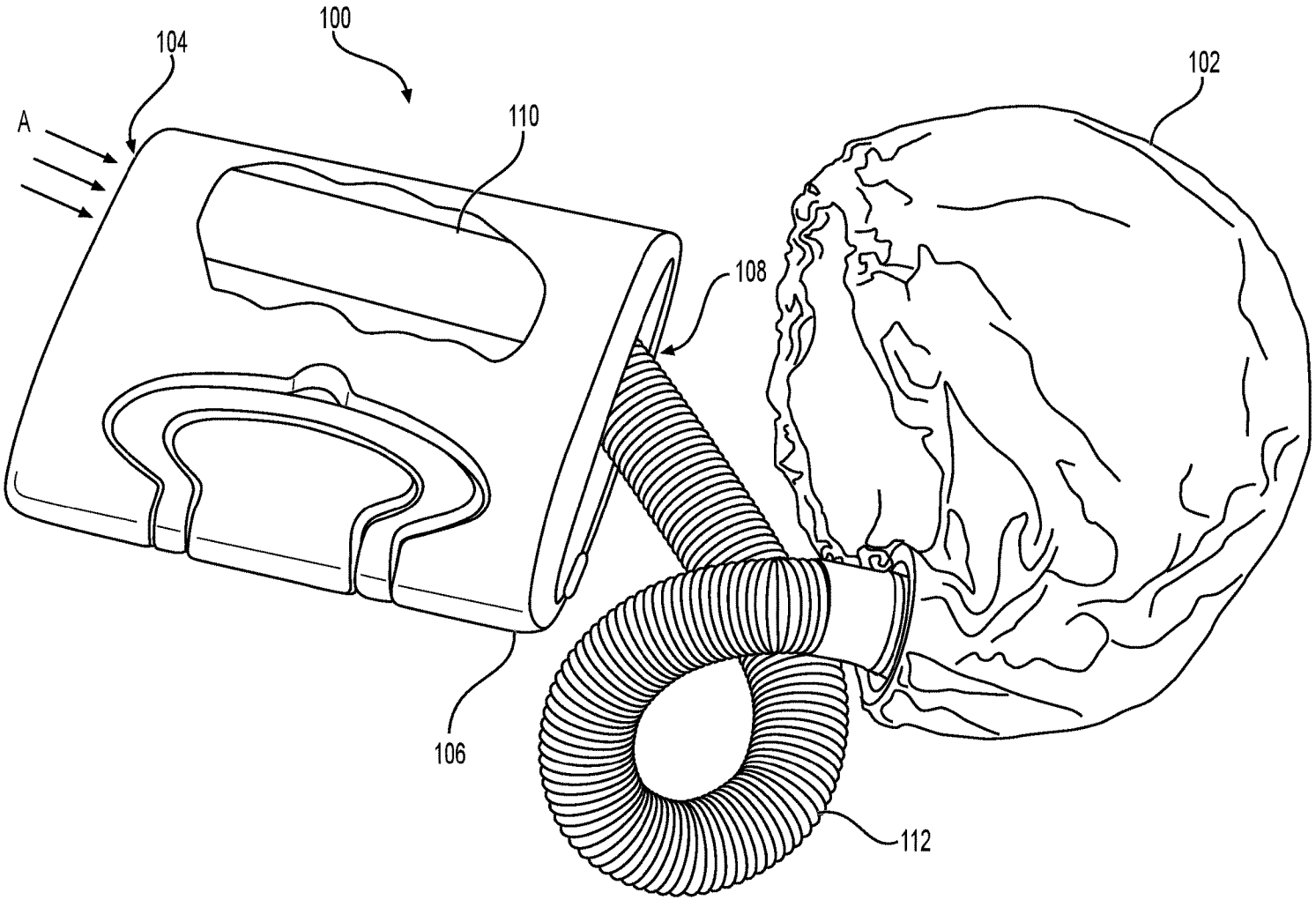
FIG. 2 (PRIOR ART)
FIG. 2 is a perspective view of an exemplary hair dryer of the prior art.
Figure 3:
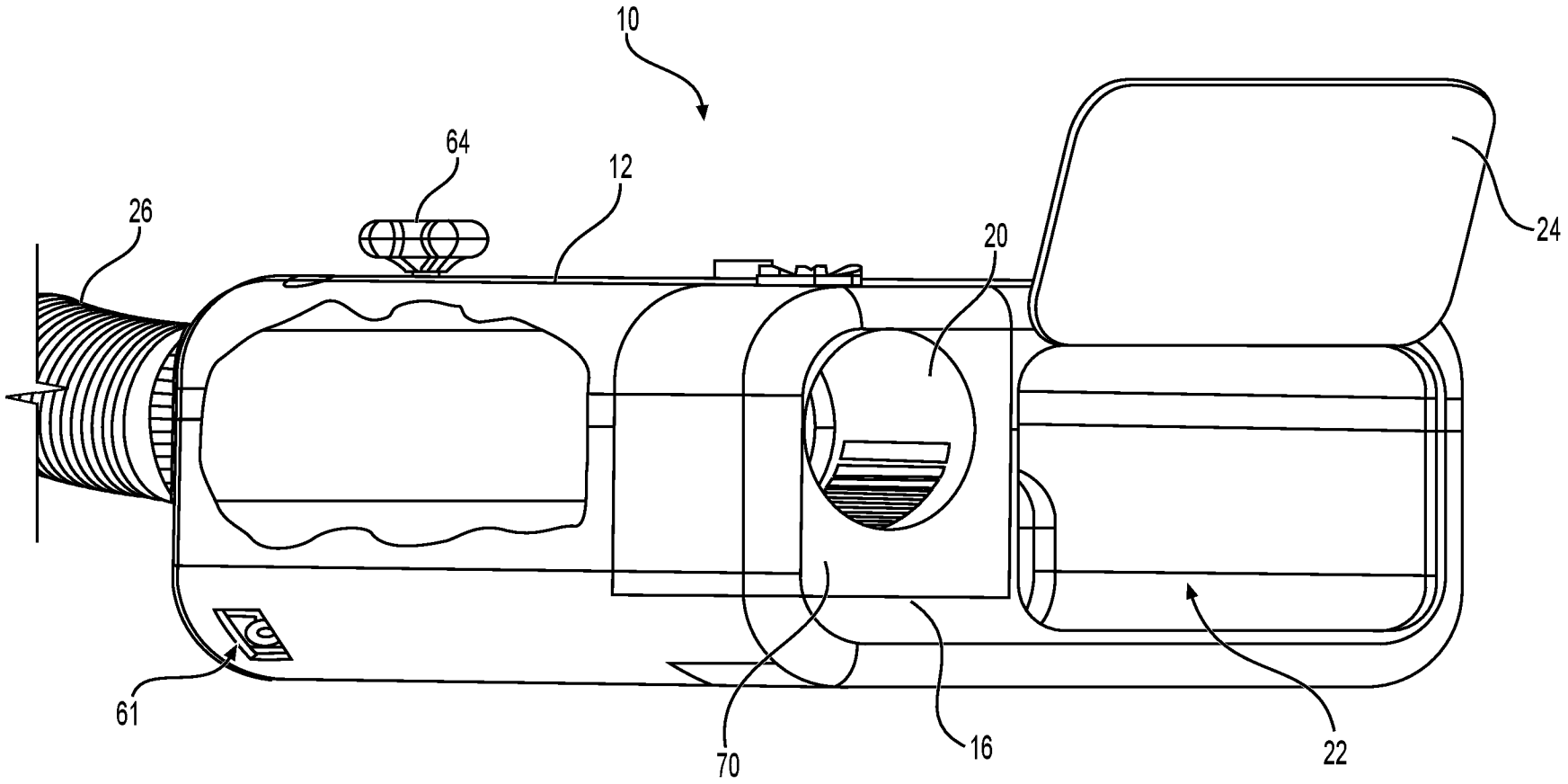
FIG. 3 is a perspective view of the hair dryer of FIG. 1 as seen from the rear of the hair dryer, the housing being partially broken away to show the interior of the housing.

The hair dryer with a scent dispenser, designated generally as 10 in the drawings, is a hair dryer that mixes a selected scent and/or incense smoke into the output heated air. As shown in FIGS. 1 and 3, the hair dryer with a scent dispenser 10 includes a housing 12 having opposed first and second ends 14, 16, respectively, an air outlet 18 at the first end 14, and an air inlet 20 at the second end 16. It should be understood that the overall configuration and dimensions of the housing 12 are shown for exemplary purposes only. A hood 34, flexible bonnet or the like may be provided for wearing over the hair of the user, as is conventionally known. The hood 34, flexible bonnet or the like has a heated air inlet 32 for releasable connection to a hose 26. A first end 28 of the hose 26 is releasably attached to the air outlet 18 of the housing 12, and an opposed second end 30 of the hose 26 is connected to the heated air inlet 32 of the hood 34. It should be understood that the hair dryer 10 may be operated without the hood 34 and the hose 26, and that the hood 34 and the hose 26 are shown for exemplary purposes only. Further, a portion of the housing 12 may also define a storage compartment 22 adjacent the second end 16 of the housing 12, providing storage for the hose 26 and the hood 34, and for hair care accessories, including combs, brushes, and the like. The storage compartment 22 may be releasably covered by a door 24 for securing the items within the housing 12 during transport and storage of the hair dryer 10.

Figure 5:
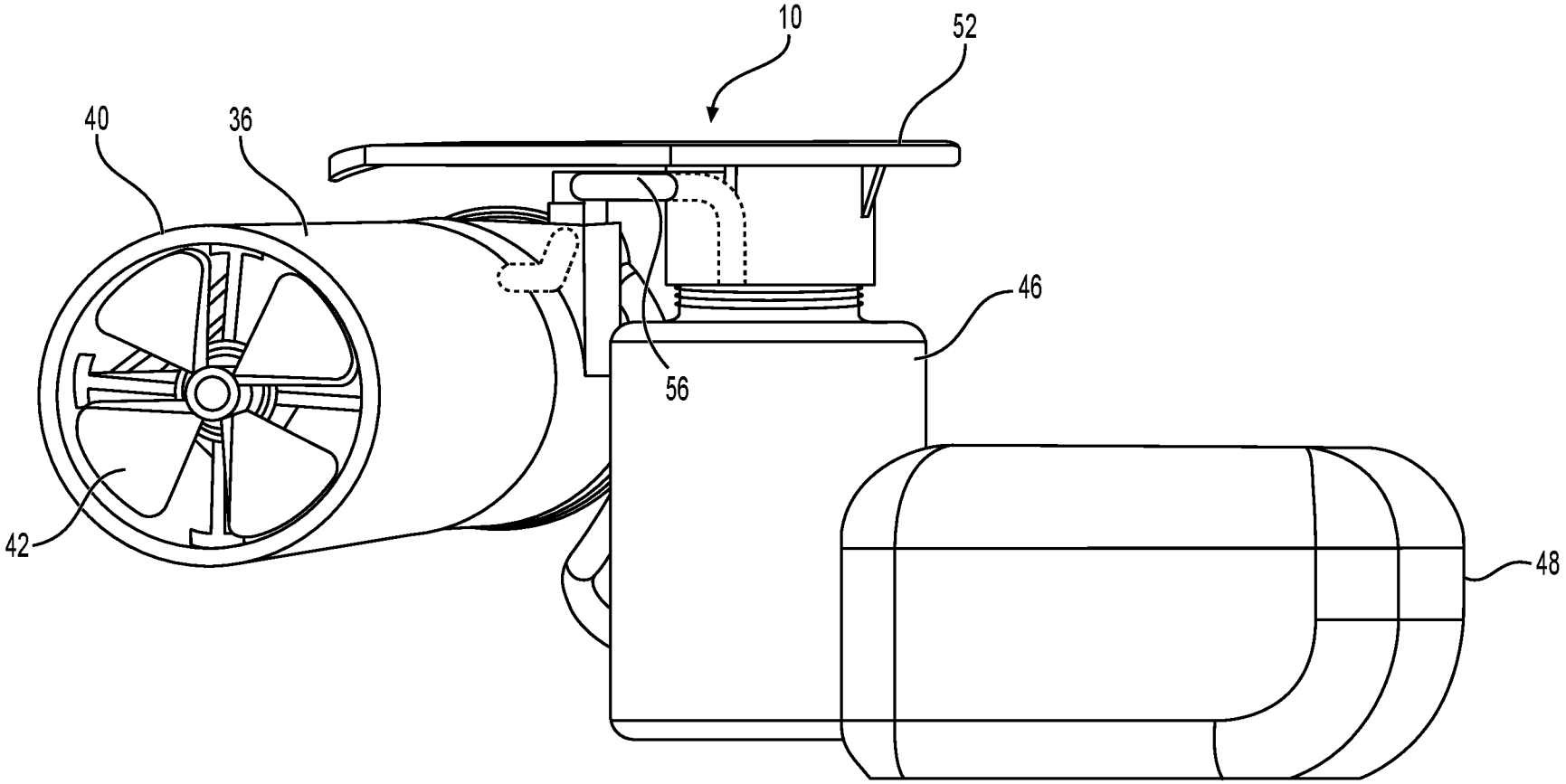
FIG. 5 is a perspective view of a scent dispensing system of the hair dryer of FIG. 1.
Figure 6:
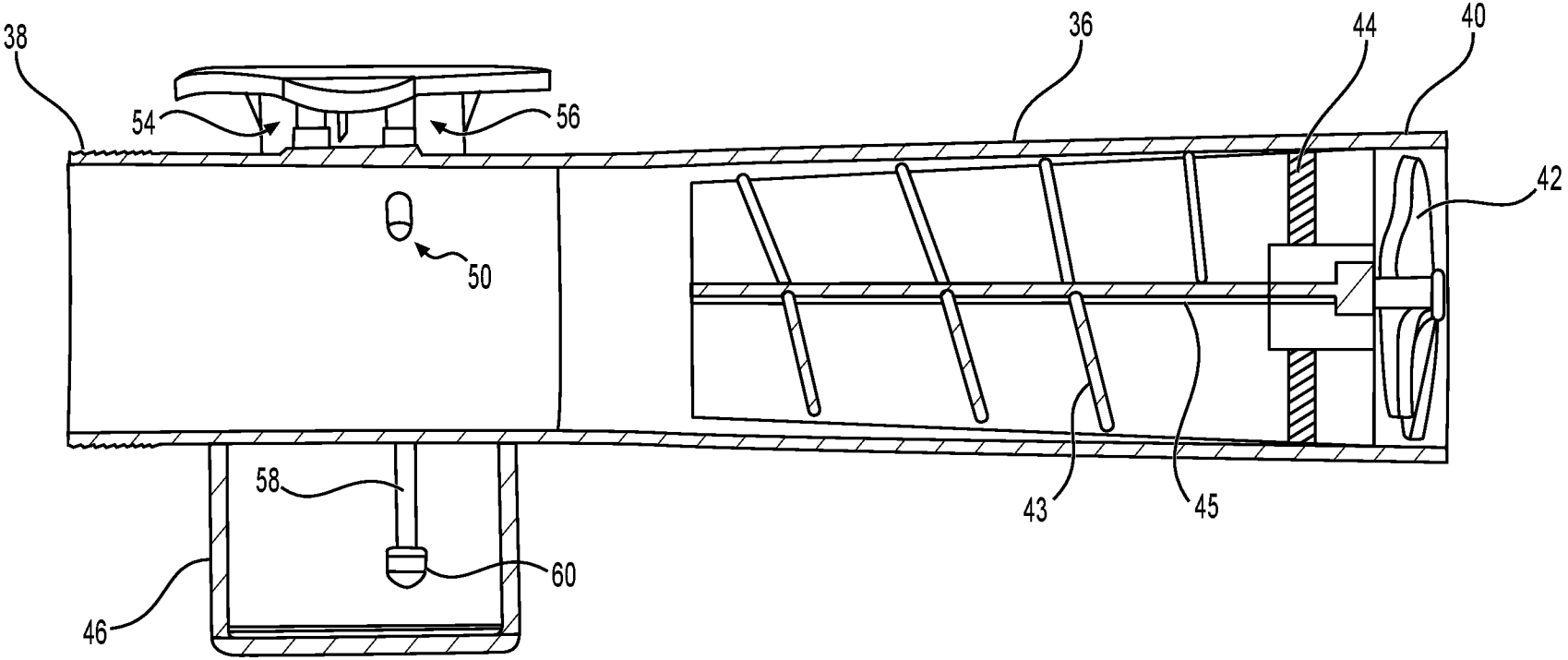
FIG. 6 is a side view in section of an airflow conduit of the hair dryer of FIG. 1.

As shown in FIGS. 5-6, an airflow conduit 36 is received within the housing 12. The airflow conduit 36 has opposed first and second ends 38, 40, respectively, the first end 38 positioned adjacent to the air outlet 18, and the second end 40 being positioned adjacent to the air inlet 20. This configuration has been selected to ensure that the scented air will not be affected or altered when passing over the heating coil. As shown in FIG. 6, a fan 42 is mounted within the airflow conduit 36 at the housing's air inlet for drawing air into the airflow conduit 36, and a heating element 44 is also mounted within the airflow conduit 36 for heating the air entering the airflow conduit 36. In FIG. 6, the fan 42 is shown having a shaft 45 with additional vanes 43 for driving the air. However, it should be understood that this configuration is shown for exemplary purposes only, and that any suitable type of fan or blower may be used. Additionally, it should be understood that any suitable type of heating coil, heating element or the like may be used to heat the air, as is conventionally known in the field of hair dryers.

Figure 4:
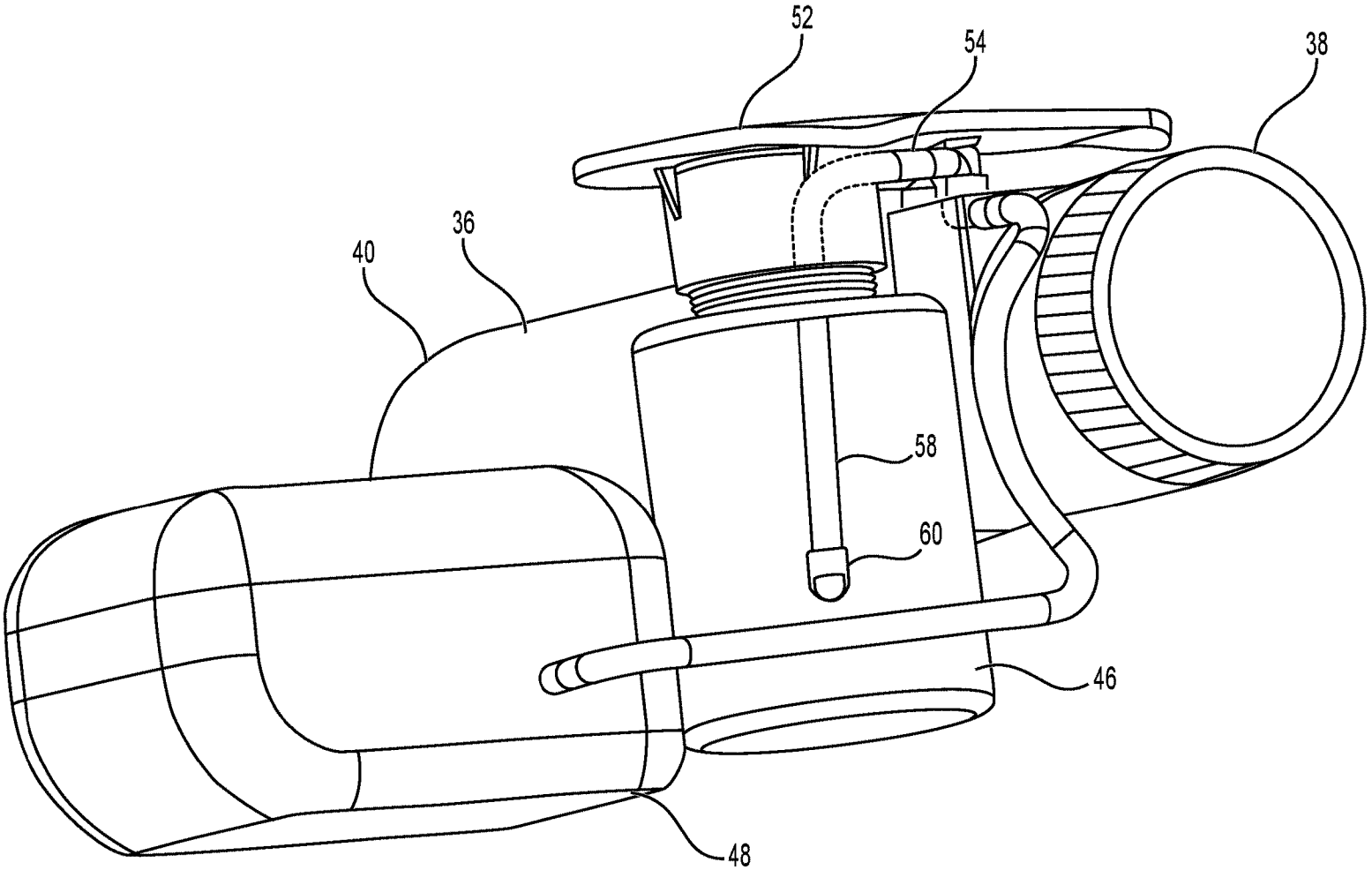
FIG. 4 is a perspective view of a scent dispensing system of the hair dryer of FIG. 1.
Figure 7:
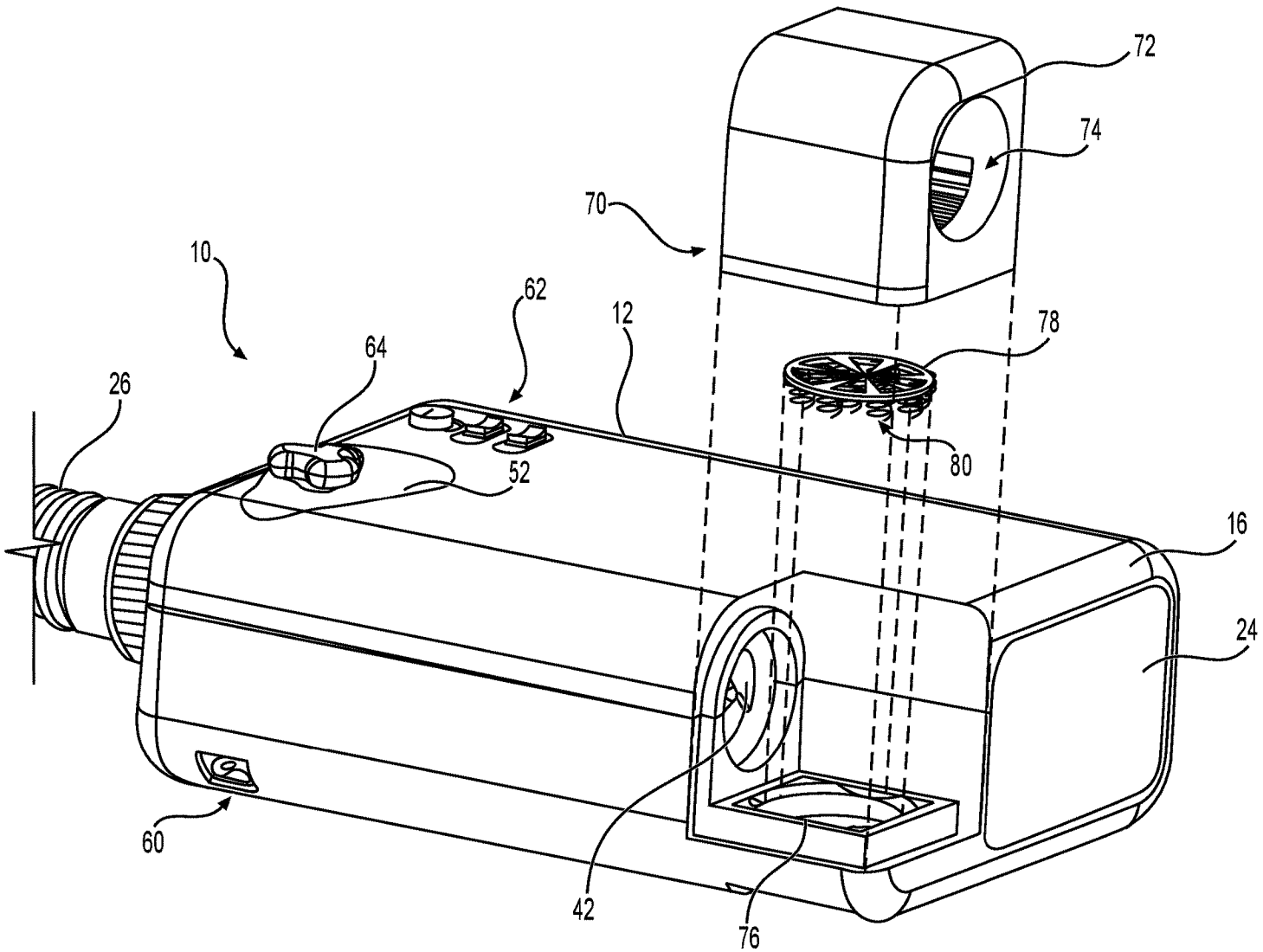
FIG. 7 is a partially exploded perspective view of the hair dryer of FIG. 1.

The heated air is blown by the fan 42 through the airflow conduit 36 and out the air outlet 18. As shown in FIGS. 4-6, a scent container 46 is disposed within the housing 12 for storing a scented liquid, such as perfume, cologne, scented oil, hair treatment ampoules, or the like. It should be understood that the overall configuration and dimensions of the scent container 46 are shown for exemplary purposes only. An air pump 48 is in fluid communication with the scent container 46 for delivering pressurized air into the scented liquid to produce scented air. The scent container 46 is in fluid communication with the airflow conduit 36 such that the scented air mixes with the heated air within the airflow conduit 36. It should be understood that any suitable type of pump, compressor or the like may be used for delivering pressurized air into the scented liquid within the scent container 46. The air pump 48 may be a variable speed air pump, providing variable control over the concentration of the scent within the heated air A removable cap 52 may be provided for releasably covering and sealing the scent container 46. As shown in FIGS. 1, 3 and 7, the removable cap 52 may be held in place with respect to the housing 12 by a threaded knob 64 or the like. The removable cap 52 allows for access to scent container 46 for the filling thereof with a desired scented liquid, as well as for cleaning the scent container, performing basic maintenance, and replacing one scent with another.

As shown in FIGS. 4, 5 and 6, the removable cap 52 has an inlet port 54 and an outlet port 56. The inlet port 54 is in fluid communication with the air pump 48 for receiving the pressurized air, and the outlet port 56 is in fluid communication with a scent port 50 of the airflow conduit 36 (shown in FIG. 6) for delivering the scented air to the airflow conduit 36. A diffuser 60 may be received within the scent container 46 for diffusing the pressurized air within the scented liquid in the scent container 46. A delivery tube 58 is in fluid communication with the inlet port 54 of the removable cap 52 and the diffuser 60 for delivering the pressurized air to the diffuser 60. It should be understood that diffuser 60 may be any suitable type of diffuser, including but not limited to, a porous diffuser or the like.

Additionally, as best seen in FIG. 7, the housing 12 may also include an incense burning compartment 70 adjacent to the air inlet 20 for producing incense smoke to be mixed with the air drawn into the airflow conduit 36. The incense burning compartment 70 includes a removable smoke conduit 72 having a smoke vent 74 formed therein, a heater 76, and a screen 78 mounted over the heater 76. The screen 78 may supported by at least one spring 80. The screen 78 is adapted for supporting incense to be burned by the heater 76. It should be understood that any suitable type of heating coil, heating element or the like may be used to burn the incense supported by screen 78. The removable smoke conduit 72 is positioned over the heater 76 and the screen 78 such that the incense smoke flows through the smoke vent 74 and into the removable smoke conduit 72, mixing with the air being drawn in by fan 42. It should be understood that the overall configuration and dimensions of the removable smoke conduit 72 are shown for exemplary purposes only. Further, it should be understood that any suitable material may be burned by the heater 76, depending upon the scent desired by the user. For example, the incense smoke may be produced by heating or burning bakhoor incense, conventional incense, wood, and the like.

Additionally, FIGS. 1 and 7 show controls 62 mounted on housing 12 for controlling operation of the hair dryer 10 during normal hair drying operations, as well as operation of the scent delivery initiated by the air pump 48 and/or the burning of the incense by the heater 76. It should be understood that the controls 62 are shown for exemplary purposes only and may have any suitable configuration. Additionally, FIG. 3 shows a port 61 for receiving a power cord for providing power to the hair dryer with a scent dispenser 10 from an external power supply. It should be understood that the positioning and configuration of the port 61 are shown for exemplary purposes only, and that external power may be provided by any suitable type of external power supply.

Figure 8:
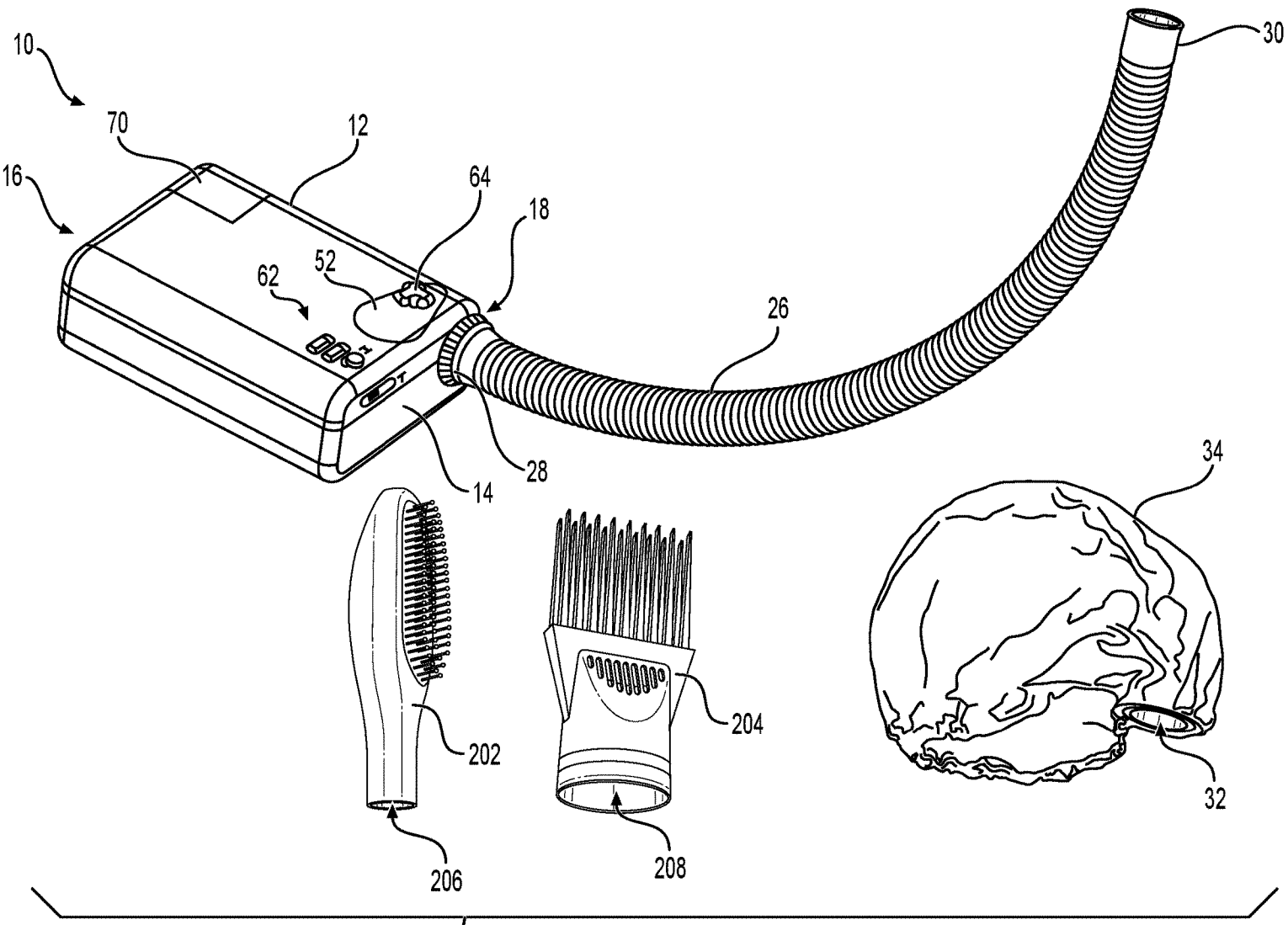
FIG. 8 is a perspective view of a scent dispensing hair dryer kit.

In the alternative embodiment of FIG. 8, the hood 34 is provided as only one member of a group of interchangeable hair care accessories for delivering the scent to the hair. The scent dispensing hair dryer kit 200 of FIG. 8 includes the hair dryer with the scent dispenser 10, the hood 34, as described above, along with a heated air dispensing brush 202 adapted for brushing the hair of the user while simultaneously blowing the heated and scented air, and a heated air dispensing comb 204 adapted for combing the hair of the user while simultaneously blowing the heated and scented air. Similar to the hood 34 described above, the heated air dispensing brush 202 and the heated air dispensing comb 204 each has a heated air inlet 206.208, respectively, for releasable connection to the second end 30 of the hose 26. The hood 34, the heated air dispensing brush 202, and the heated air dispensing comb 204 are interchangeable, depending upon the needs of the user. It should be understood that any suitable hair care accessories may be provided as part of the kit 200, and that the kit 200 is not limited to, or limited to requiring, the hood 34, the heated air dispensing brush 202, or the heated air dispensing comb 204. It should be further understood that the overall configuration of the heated air dispensing brush 202 and the heated air dispensing comb 204 are shown in FIG. 8 for exemplary purposes only.

It is to be understood that the hair dryer with a scent dispenser is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

We claim:

1. A hair dryer with a scent dispenser, comprising:

a housing having opposed first and second ends, an air outlet at the first end, and an air inlet at the second end;

an airflow conduit disposed within the housing, the airflow conduit having opposed first and second ends, the first end of the airflow conduit being positioned adjacent to the air outlet, and the second end of the airflow conduit being positioned adjacent to the air inlet;

a fan mounted within the airflow conduit, the fan drawing air into the airflow conduit;

a heating element mounted within the airflow conduit, the heating element heating the air drawn in by the fan, the heated air being blown by the fan through the airflow conduit and out of the air outlet;

a scent container received within the housing, the scent container being adapted for storing a scented liquid;

an air pump in fluid communication with the scent container and delivering pressurized air into the scented liquid to produce scented air, the scent container being in fluid communication with the airflow conduit such that the scented air mixes with the heated air within the airflow conduit in order to deliver a scent in the heated air when drying a user's hair;

a hood adapted for wearing over hair of a user, the hood having a heated air inlet; and a hose having opposed first and second ends, the first end being releasably attached to the air outlet of the housing, the second end being releasably attached to the heated air inlet of the hood.

2. The hair dryer as recited in claim 1, wherein the housing has a storage compartment defined therein adjacent to the second end of the housing.

3. The hair dryer as recited in claim 1, wherein the air pump comprises a variable speed air pump.

4. The hair dryer as recited in claim 1, further comprising a removable cap for releasably covering and sealing the scent container.

5. The hair dryer as recited in claim 4, wherein the removable cap has an inlet port and an outlet port, the inlet port being in fluid communication with the air pump for receiving the pressurized air, and the outlet port being in fluid communication with the airflow conduit for delivering the scented air to the airflow conduit.

6. The hair dryer as recited in claim 5, further comprising:

a diffuser disposed in the scent container, the diffuser diffusing the pressurized air within the scented liquid in the scent container; and a delivery tube in fluid communication with the inlet port of the removable cap and the diffuser for delivering the pressurized air to the diffuser.

7. The hair dryer as recited in claim 1, wherein the housing further comprises an incense burning compartment adjacent to the air inlet, the incense burning compartment being adapted for producing incense smoke for mixing with the air drawn into the airflow conduit.

8. The hair dryer as recited in claim 7, wherein the incense burning compartment comprises:

a removable smoke conduit having a smoke vent formed therein;

a heater; and a screen mounted over the heater, the screen being adapted for supporting incense to be burned by the heater, the removable smoke conduit being positioned over the heater and the screen such that the incense smoke flows through the smoke vent and into the removable smoke conduit.

9. The hair dryer as recited in claim 8, further comprising at least one spring supporting the screen over the heater.

10. A hair dryer with a scent dispenser, comprising:

a housing having opposed first and second ends, an air outlet at the first end, and an air inlet at the second end;

an airflow conduit disposed within the housing, the airflow conduit having opposed first and second ends, the first end of the airflow conduit being positioned adjacent to the air outlet, and the second end of the airflow conduit being positioned adjacent to the air inlet;

a fan mounted within the airflow conduit, the fan drawing air into the airflow conduit;

a heating element mounted within the airflow conduit, the heating element heating the air drawn in by the fan, the heated air being blown by the fan through the airflow conduit and out of the air outlet; and an incense burning compartment disposed in the housing adjacent to the air inlet, the incense burning compartment being adapted for producing incense smoke for mixing with the air drawn into the airflow conduit.

11. The hair dryer as recited in claim 10, further comprising:

a scent container disposed within the housing, the scent container being adapted for storing a scented liquid; and an air pump in fluid communication with the scent container, the air pump delivering pressurized air into the scented liquid to produce scented air, the scent container being in fluid communication with the airflow conduit such that the scented air mixes with the heated air within the airflow conduit.

12. The hair dryer as recited in claim 11, wherein the air pump comprises a variable speed air pump.

13. The hair dryer as recited in claim 11, further comprising:

a hood adapted for wearing over hair of a user, the hood having a heated air inlet; and a hose having opposed first and second ends, the first end being releasably attached to the air outlet of the housing, the second end being releasably attached to the heated air inlet of the hood.

14. The hair dryer as recited in claim 11, further comprising a removable cap for releasably covering and sealing the scent container.

15. The hair dryer as recited in claim 14, wherein the removable cap has an inlet port and an outlet port, the inlet port being in fluid communication with the air pump for receiving the pressurized air, the outlet port being in fluid communication with the airflow conduit for delivering the scented air to the airflow conduit.

16. The hair dryer as recited in claim 15, further comprising:

a diffuser disposed in the scent container, the diffuser diffusing the pressurized air within the scented liquid in the scent container; and a delivery tube in fluid communication with the inlet port of the removable cap and the diffuser for delivering the pressurized air to the diffuser.

17. The hair dryer as recited in claim 10, wherein the incense burning compartment comprises:

a removable smoke conduit having a smoke vent formed therein;

a heater; and a screen mounted over the heater, the screen being adapted for supporting incense to be burned by the heater, the removable smoke conduit being positioned over the heater and the screen such that the incense smoke flows through the smoke vent and into the removable smoke conduit.

18. The hair dryer with a scent dispenser as recited in claim 17, further comprising at least one spring for supporting the screen.

19. A scent dispensing hair dryer kit, comprising:

a hair dryer with a scent dispenser, including:

a housing having opposed first and second ends, an air outlet at the first end, and an air inlet at the second end;

an airflow conduit disposed within the housing, the airflow conduit having opposed first and second ends, the first end of the airflow conduit being positioned adjacent to the air outlet, and the second end of the airflow conduit being positioned adjacent to the air inlet;

a fan mounted within the airflow conduit, the fan drawing air into the airflow conduit;

a heating element mounted within the airflow conduit, the heating element heating the air drawn in by the fan, the heated air being blown by the fan through the airflow conduit and out of the air outlet;

a scent container disposed within the housing, the scent container being adapted for storing a scented liquid;

an air pump in fluid communication with the scent container, the air pump delivering pressurized air into the scented liquid to produce scented air, the scent container being in fluid communication with the airflow conduit such that the scented air mixes with the heated air within the airflow conduit; and a hose having opposed first and second ends, the first end being releasably attached to the air outlet of the housing;

a hood adapted for wearing over hair of a user, the hood having a hood's heated air inlet for releasable connection to the second end of the hose;

a heated air dispensing comb adapted for combing the hair of the user and for simultaneously blowing the heated air, the heated air dispensing comb having a comb's heated air inlet for releasable connection to the second end of the hose; and a heated air dispensing brush adapted for brushing the hair of the user and for simultaneously blowing the heated air, the heated air dispensing brush having a brush's heated air inlet for releasable connection to the second end of the hose, the hood, the heated air dispensing comb, and the heated air dispensing brush being alternately attachable to the second end of the hose.

* * * * *